US007240463B2

(12) United States Patent
Masterson et al.

(10) Patent No.: US 7,240,463 B2
(45) **Date of Patent: *Jul. 10, 2007**

(54) STRUCTURAL MEMBER FOR USE IN THE CONSTRUCTION OF BUILDINGS

(75) Inventors: Eric Masterson, Tomball, TX (US); Leonard George, Hempstead, TX (US)

(73) Assignee: NCI Building Systems, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/404,304

(22) Filed: Apr. 14, 2006

(65) Prior Publication Data

US 2006/0179781 A1 Aug. 17, 2006

Related U.S. Application Data

(63) Continuation of application No. 11/025,039, filed on Dec. 29, 2004, now Pat. No. 7,086,208, and a continuation of application No. 10/314,852, filed on Dec. 9, 2002, now Pat. No. 6,874,294, and a continuation of application No. 09/604,485, filed on Jun. 27, 2000, now Pat. No. 6,519,908.

(51) Int. Cl.
*E04C 3/02* (2006.01)

(52) U.S. Cl. ..... 52/693; 52/289; 52/702

(58) Field of Classification Search ..... 52/693, 52/696, 289, 702, 690, 695
See application file for complete search history.

(56) References Cited

U.S. PATENT DOCUMENTS 2,514,607 A * 7/1950 McLean ..... 52/692
3,353,320 A * 11/1967 Grasis ..... 52/693
4,349,996 A * 9/1982 Lautensleger et al. ..... 52/650.2
4,982,545 A * 1/1991 Stromback ..... 52/639
5,771,653 A * 6/1998 Dolati et al. ..... 52/737.6

(Continued)

*Primary Examiner*—Jeanette Chapman
*Assistant Examiner*—Jessica Laux
(74) *Attorney, Agent, or Firm*—Gardere Wynne Sewell LLP

(57) ABSTRACT

A metal building includes a joist system having upper and lower longitudinally extending chords, the upper and lower chords being substantially parallel, and a plurality of web members interposed between the parallel chords. Each of the chords includes an upper chord segment, opposed parallel side walls, inwardly extending lower chord segments, the lower chord segments being parallel to the upper chord segment, and a pair of flanges extending downwardly from the innermost edges of lower chord segments, the flanges defining a longitudinally extending continuous web receiving aperture traversing the length of the chord, the upper chord segment, lower chord segment, parallel side walls and flanges, the web receiving apertures of the upper and lower chords being positioned in opposed relationship. A plurality of web members are provided, each of the web members including an upper web segment, the width of the upper web segment being equal to the width of the web receiving aperture, opposed parallel side walls extending perpendicularly from the upper web segment, and inwardly extending lower web segments, the inwardly extending lower web segments defining a longitudinally extending slot, each of the web members having first and second ends received in the web receiving aperture. A saddle is provided for positioning the joists, each saddle having an upper saddle member, opposed parallel side members and outwardly extending bearing plates, the outwardly extending bearing plates being parallel to the upper saddle member, the upper chord of the joist receiving the saddle in the member receiving aperture at opposed ends of the joist to support the joist.

20 Claims, 4 Drawing Sheets

U.S. PATENT DOCUMENTS 5,865,008 A * 2/1999 Larson ..... 52/690
6,073,414 A * 6/2000 Garris et al. ..... 52/694
6,874,294 B2 * 4/2005 Masterson et al. ..... 52/696

* cited by examiner

STRUCTURAL MEMBER FOR USE IN THE CONSTRUCTION OF BUILDINGS

CROSS-REFERENCES TO RELATED APPLICATIONS

This application is a CON of Ser. No. 11/025,039 Dec. 29, 2004 U.S. Pat. No. 7,086,208 and is a CON of Ser. No. 10/314,852 Dec. 9, 2002 U.S. Pat. No. 6,874,294 and is a CON of Ser. No. 09/604,485 Jun. 27, 2000 U.S. Pat. No. 6,519,908.

TECHNICAL FIELD OF THE INVENTION

The invention relates to the construction of buildings and in particular to the construction of buildings employing steel framing for various components of the building. More specifically the invention relates to a metal joist for supporting roofs, floors, ceilings and decks.

BACKGROUND OF THE INVENTION

Without limiting the scope of the invention, its background is described in connection with reference to the construction of buildings and in particular the construction of buildings employing steel framing for various components of the building.

In the past, a number of joist systems have been designed and fabricated for use in building construction. Typically, such joists have been used as floor, roof and deck supports. The design and fabrication of such joists have largely been on an application-by-application or building-by-building basis. Additionally, the fabrication of such joist systems has been complicated due to constraints imposed by the particular design of the joist components and the fastening system used to connect the joist components.

Thus, there exists a need for a simplified joist systems and design wherein components can be more standardized while still meeting the requirements of difference building designs.

SUMMARY OF THE INVENTION

In one embodiment of the invention, a building includes a metal roof and joist system. As used herein the term "metal building" refers to a structure having a frame composed primarily of metal members, including the joist of the invention. The joist system includes upper and lower longitudinally extending chords 12, 24, having substantially identical cross-sectional geometry. The upper and lower chords are substantially parallel and a plurality of web members 30 are interposed between the parallel chords. Each of the chords 12, 24 is comprised of an upper chord segment 14, opposed parallel side walls 16, and inwardly extending lower chord segments 18, with the lower chord segments being parallel to the upper chord segment. A pair of flanges 20 extend downwardly from the innermost edge of each of the inwardly extending lower chord segments 18 of the chord. The flanges 20 define a longitudinally extending continuous web receiving aperture 22 traversing the length of the chord. Preferably, these chord members are integrally formed from a single steel sheet or plate.

Each of the web members is formed from an upper web segment 32, opposed parallel side walls 34 extending perpendicularly from the upper web segment, and inwardly extending lower web segment 36. The innermost edges of the inwardly extending lower web segments 36 define a longitudinally extending slot 38. Preferably, the upper web segment, parallel side walls, inwardly extending lower web segments 36 are also integrally formed from a single steel sheet or plate. Each of the web members has first and second ends received in the web receiving apertures 22 of the chords. The web members 30 are secured to the upper and lower chords by welding, or with mechanical means selected from a group consisting of screws, bolts, and rivets and combinations thereof. In practice, the web receiving apertures of the upper and lower chords are positioned in opposed parallel relationship and the width of the web receiving aperture 22 is equal to the width of the upper web segment 32 of each of the web members so that the web members abut the flanges of each of the chords when the joist is fabricated.

A saddle is provided for receiving and positioning the ends of the joists on a horizontal structure such as a wall, or on a floor, deck or roof frame. The saddles include an upper saddle member, opposed parallel side members and outwardly extending bearing plates, the outwardly extending bearing plates being parallel to the upper saddle member. The saddle is received or seated in the upper chord of the joist to position and support the joist.

The joists and system of the invention are simple yet elegant in design, requiring a minimum of stock materials. The joists may be quickly and easily fabricated, reducing overhead and labor costs typically associated with the fabrication of structural members. The open construction of the chords and web members allows for variations in material dimensions which might otherwise impede or slow fabrication. If desired, due to the design of the joists of the invention, the joists may be quickly and easily fabricated on site from precut sections.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

Figure 1:
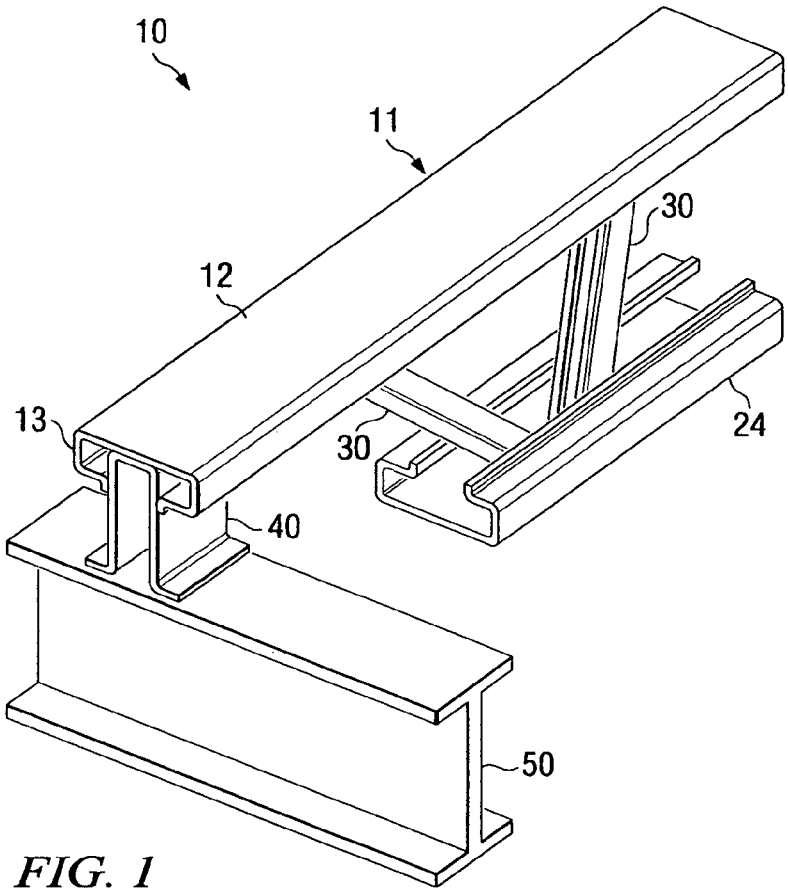
FIG. 1 is a partial perspective view of the joist system of the invention.
Figure 2:
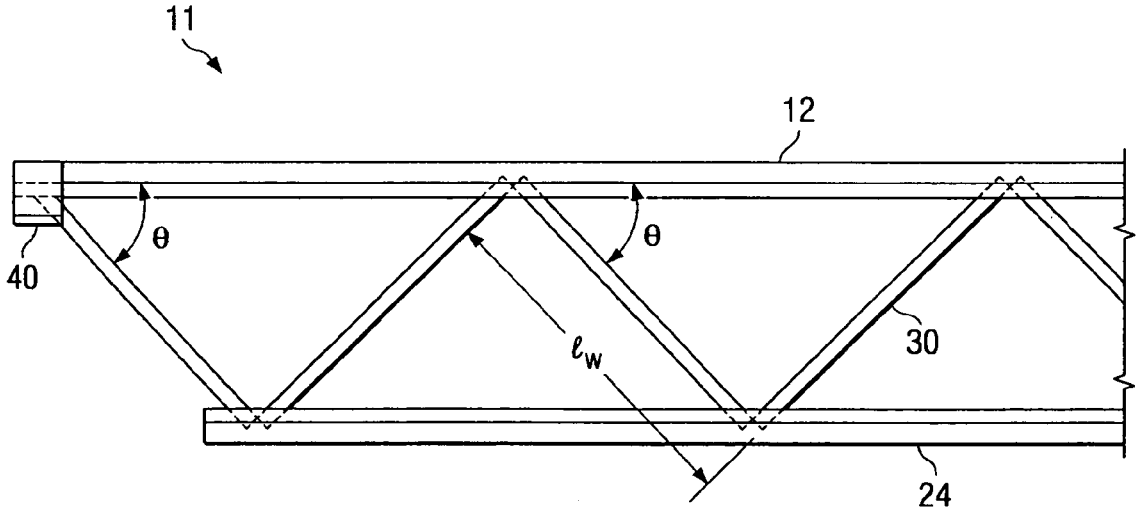
FIG. 2 is a partial side view of a joist employed in the system of the invention.
Figure 8:
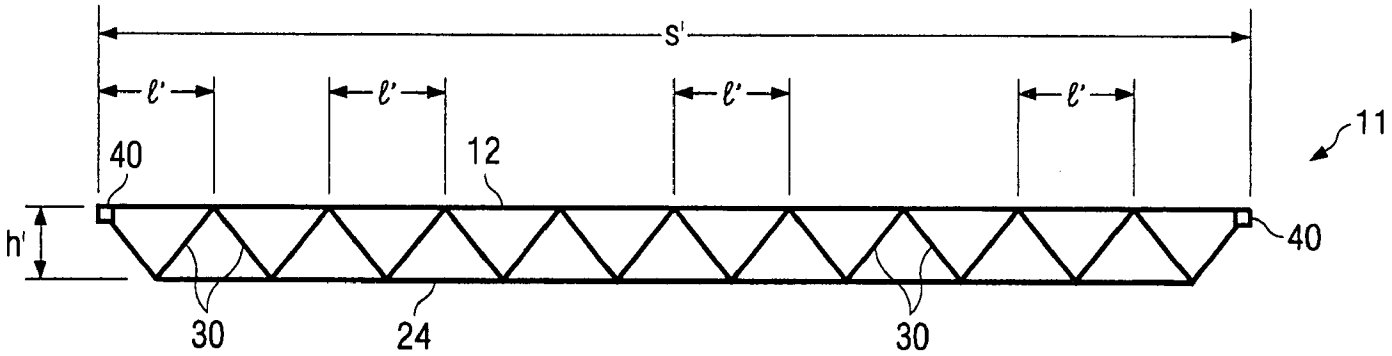
FIG. 8 is a side perspective view of a joist of the invention.

Referring now to FIGS. 1, 2 and 8, the joist system of the invention is illustrated. The system includes a joist 11 with upper chord 12, lower chord 24, web members 30 and saddle 40. As illustrated, the upper chord 12 of joist 11 is seated over saddle 40 to position and retain the joist 11 in the desired position on top of a receiving structure such as I-beam 50. Also, as illustrated, lower chord 24 is shorter than upper chord 12 in order to allow the joist 11 to be positioned upon I-beam 50 or a similar horizontally positioned support structure such as a wall, deck or roof frame.

Figure 3:
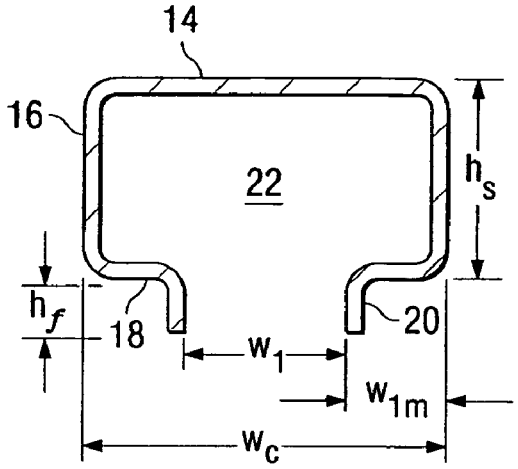
FIG. 3 is a cross-sectional view of a chord used in the joist of the invention.

Referring now to FIG. 3, a cross-sectional view of chord 12 is presented, it being understood that the geometry of upper chord 12 and lower chord 24 is similar. Chord 12 includes a longitudinally extending upper chord segment 14, longitudinally extending opposed side walls 16, longitudinally extending lower chord segments 18 and parallel opposed flanges 20. As shown, the lower chord segments 18 are substantially parallel to the upper chord segment 14 and the downwardly extending flanges 20 are substantially parallel to side walls 16. The flanges 20 define a web member receiving aperture 22 that extends the length of the chords 12, 24. Preferably, the upper chord segment 14, side walls 16, lower chord segments 18 and flanges 20 are integrally formed, for example, by cold forming a single steel sheet or plate. However, it will be understood that the components of chord 12 could otherwise be fabricated and assembled, for example, by cutting and welding the components from sheet steel. In a typical application the width $w_c$ of the chord 12 is 4 inches, the height $h_s$ is 1.5 to 2. inches, and the height $h_f$ of the flanges is 11/16th inch. These dimensions result in a width $w_{lm}$ of the lower chord segments of about 1 3/8th inch. These precise dimensions are provided only for the purposes of illustration, it being understood that this shape of chord 12 may be fabricated with slightly different or substantially different dimensions.

Figure 4:
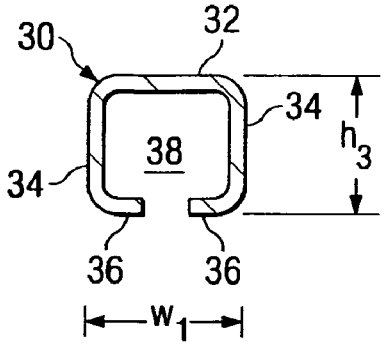
FIG. 4 is a cross-sectional view of a web member used in the joist of the invention.

Turning now to FIG. 4, a cross-sectional view of a web member 30 suitable for use in connection with the invention is illustrated. The web member 30 includes a longitudinally extending upper web segment 32, opposed parallel side walls 34 and longitudinally extending lower web segments 36. The longitudinally extending lower web segments define a longitudinally extending slot 38 that extends the length of the web member 30. As shown, the upper web segment member 32, side walls 34 and lower web segments 36 are integrally formed from a single piece of sheet steel, however, it will be recognized that the individual components of the web member 30 could be otherwise fabricated and assembled, for example by welding.

Figure 7:
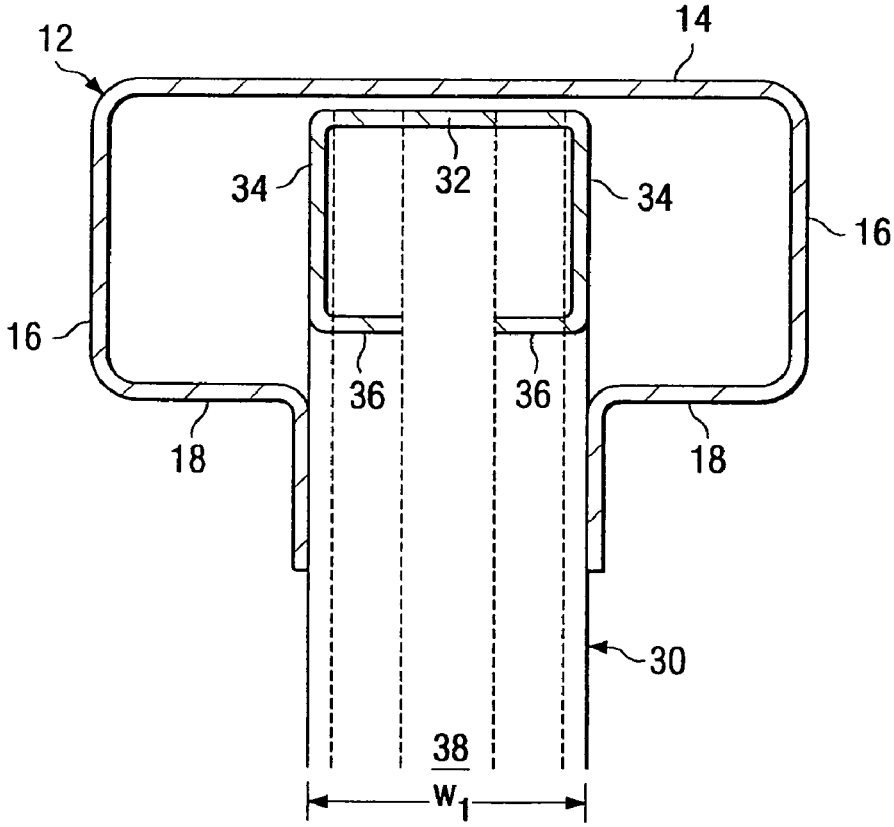
FIG. 7 is a partial cross-sectional view of a chord and web member of the joist system of the invention.

Referring now to FIGS. 3, 4 and 7, the inside width $w_1$ of the web member receiving aperture 22 is preferably equal to the exterior width of web member 30 to insure an abutting relationship, i.e., no gap or space, between side walls 34 of web member 30 and the inside surfaces of flanges 20 of chord 12. The abutting relationship between side walls 34 and flanges 20 aids in the proper placement of the web member 30 when it is inserted into chord 12. Additionally, the geometry of chord 12 and web member 30 facilitates welding the web member in place after it has been inserted into the chord 12 during fabrication.

Figure 6:
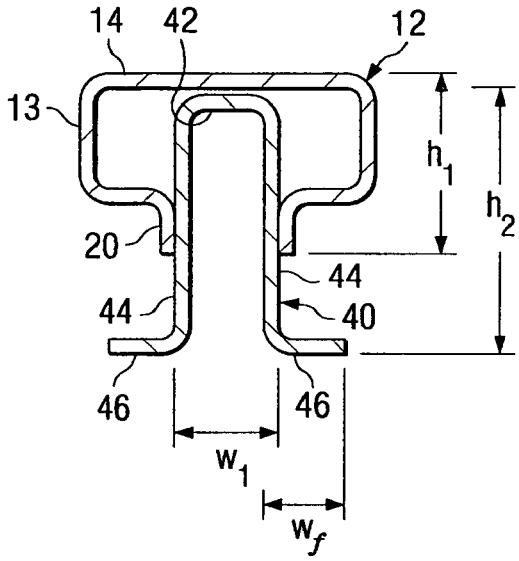
FIG. 6 is a cross-sectional view of a receiving saddle seated in an upper chord of a joist in accordance with the joist system of the invention.

Turning now to FIG. 6, a cross-sectional view of a first end 13 of chord 12 seated on saddle 40 is presented. The saddle 40 includes a top member 42, opposed parallel side walls or side members 44 and load bearing flanges 46. It will be appreciated that top member 40, side walls 44 and load bearing flanges 46 of saddle 40 may be integrally formed from a single steel sheet or plate or otherwise fabricated, for example, by cutting and welding a steel plate. In a typical application, the height $h_2$ of the saddle 40 is 4 to 6 inches, typically 4 or 4.5 inches, and the width $w_f$ of the load bearing flanges is 1 to 2 inches, typically 1 5/16 inches. Again, these dimension are for illustration only, the saddle 40 may be fabricated with other varying dimensions depending upon the specific application.

As shown, the interior height or depth $h_1$ of chord 12 is less than the exterior height $h_2$ of saddle 40. Consequently, when chord 12 is seated on saddle 40, the exterior surface of upper chord segment 42 of the saddle 40 abuts the inside surface of upper chord segment 14 of chord 12 along the length of the saddle 40, transferring the load on joist 11 to the saddle. A second end 13 of the chord 12 is seated over an identical saddle 40 at the other end of the span. Also, as shown, the width $w_1$ between the exterior surfaces of side walls 44 of saddle 40 is equal to the width $w_1$ of the web member receiving aperture 22 of chord 12. This insures an abutting relationship between side walls 44 of saddle 40 and the inside surfaces of flanges 20 of chord 12, i.e., no gap or space. The abutting relationship between side walls 44 and flanges 20 facilitates proper placement of chord 12 when it is seated onto saddle 40. Additionally, the geometry of chord 12 and saddle 40 provides a joint that can be welded with a minimum of difficulty during fabrication.

The open geometry of the chords 12 and 24, and web members 30, also provide tolerance for manufacturing variations. As used herein, the term "open geometry" refers to a structure having a non-continuous exterior perimeter as opposed to, for example, a closed rectangular beam or cylinder. Thus, for example, if the outside dimension of a web member 30 is slightly larger than the width $w_1$ of the web receiving aperture 22, the side walls 16 of chord 12 are capable of flexing outwardly to allow the web member 30 to be inserted. Alternatively, if the outside dimension of the web member is slightly less than the width of the web member receiving aperture 22, the structure of chord 12 is sufficiently flexible to allow flanges 20 to be clamped down onto the web member 30 for fastening. Likewise, the open geometry of the web member 30 provides a degree of flexibility. Similarly, the open geometry of chord 12 allows for variations in the width of saddle 40.

Turning now to FIGS. 2, 5, 7 and 8, the construction of the joist of the invention will be further explained. Once the span (FIG. 8) of a joist is determined, the lengths of the upper chord 12 and the lower chord 24 are determined, allowing, of course, sufficient length of the upper chord for seating in saddle 40. As previously noted, the lower chord 24 will usually be shorter than upper chord 12 to allow the joist to be positioned upon a support structure such as a beam or frame without interference between the lower chord and the support structure. Depending upon the length of the spans, the load on the roof, floor or deck to be installed over the joists, and the desired height h' of the joist, the chords may be produced for differing gauges or thickness of steel. In most cases, depending upon the particular application, the height of the joist will be between 1.5 and 3.0 feet.

After the length and gauge of the chords 12 and 24 have been determined, the web member 30 are produced, typically by cutting a continuous channel, having the previously described geometry, into the desired length. A significant advantage provided by the joist of the invention is that the design of the joist allows the use of more than one gauge web member for different spans and joist heights. For example, as noted above, typical applications require joist heights of from about 1.5 ft. to about 3.0 ft. Typical spans may range up to 60 ft. in length. Within these ranges, it is possible to use a single web member shape with multiple thicknesses, i.e., a 16 gauge steel channel or 14 gauge steel channel having the geometry described above, to produce the web members. This, in turn, alleviates the need to maintain different channel forming tools to fabricate web members and reduces inventory costs and the amount of storage space required while maximizing design efficiency.

Thus, the web members can be pre-cut for use in joists of various heights. In one application, a joist having a height h' of 1.5 ft and segment lengths 1' of 4 ft. (FIG. 8) may use substantially rectangular steel 16 gauge web members, as illustrated in FIG. 4, having a width $w_1$ and a height $h_3$ of 1.25 inches, corresponding to width $w_1$ of the web receiving apertures of chords 12 and 24. In this case, the length of the web members $l_w$ will be approximately 4.25 ft. and the incident angle θ (FIG. 2) will be approximately 20°. If the height h' of the joist is 3.0 feet and the segment length is 4.0 feet, the length $l_w$ of the web members will be approximately 5.0 ft. and the incident angle θ will be approximately 37° and the channel may be formed from 16 gauge through 12 gauge material. Of course, numerous variations in joist height, span length, segment length and materials are possible. Thus, the foregoing descriptions are by means of illustration only.

Figure 5:
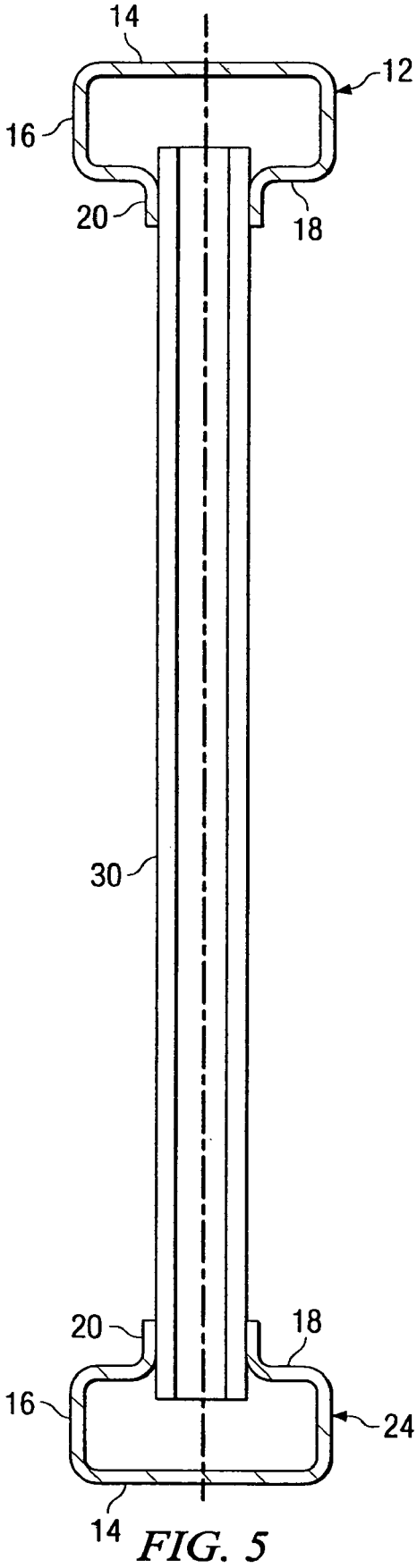
FIG. 5 is a partial cross-sectional view of one embodiment of the joist of the invention.

After the chords 12, 24 and web member 30 have been sized, the ends of the web members 30 are inserted into the web member receiving apertures 22 of the chords as illustrated in FIGS. 2, 5 and 7, with the ends of adjacent web members abutting each other. The web members may then be welded into place to form the joist 11. As will be appreciated, other methods of fastening the web members 30 to the chords 12, 24, such as bolting, riveting or adhering with an appropriate adhesive, may be utilized.

Figure 9:
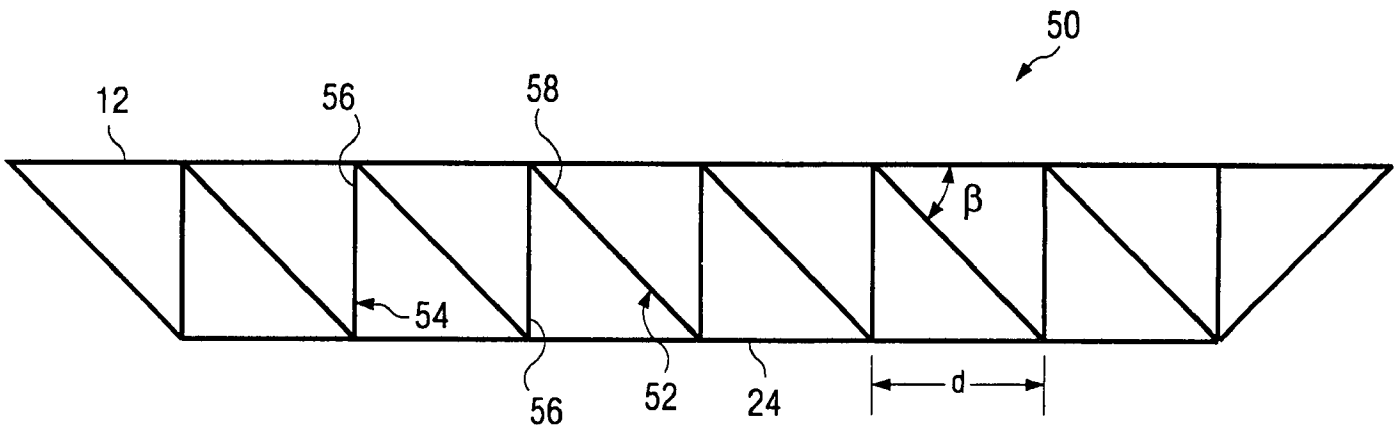
FIG. 9 is a perspective side view of a joist of the invention having an alternate web configuration.

Turning now to FIG. 9, there is illustrated an alternate embodiment of a joist 50 in accordance with the invention. In the embodiment shown in FIG. 9, web members 52 and 54 with differing lengths are utilized. Perpendicular web members 54, having ends 56, extend between and intersect chords 12 and 24 at an angle of 90°. Interposed between perpendicular web members 54 are diagonal web members 52, having ends 58, intersect chords 12, 24 at an incident angle β of less than 90°, the exact angle depending upon the distance d between successive perpendicular web members which, in turn, depends upon the particular application and design criteria. The ends of web members 52, 54 are positioned in abutting relationships with web members receiving aperture 22 and are secured therein by any appropriate means, e.g. welding, bolting, riveting or adhering with an appropriate adhesive. Thus, as will be appreciated, joist 50 of FIG. 9 is substantially similar to joist 11 of FIGS. 1 and 2 in all material respects, including the geometry of chords 12, 24 and web members 30 with the exception of the length and configuration of the web members 52, 54.

The joist and joist system of the invention provide numerous advantages over currently used joists and systems. The joists of the invention are simple, yet elegant in design, requiring a minimum of stock materials. The joists of the invention are quickly and easily fabricated, reducing overhead and labor costs typically associated with the fabrication of structural members. Once the saddles 40 of the system have been located and secured, the joists 11 may be quickly and easily placed, seating the ends of the upper chords 12 over the saddles. Thus, the joist system of the invention provides for rapid construction of buildings, reducing labor costs and construction times. The open construction of the chords 12, 24 and web members 30 allows for variations in material dimensions that might otherwise impede or slow fabrication. If desired, due to the design of the joists of the invention, the joists may be quickly and easily fabricated on site from precut sections.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

The invention claimed is:

1. A joist system comprising:

upper and lower longitudinally extending chords, the upper and lower chords being substantially parallel, and a plurality of web members interposed between the parallel chords;

each of the chords including an upper chord segment, opposed parallel side walls, inwardly extending lower chord segments, the lower chord segments being parallel to the upper chord segment, and a pair of flanges extending downwardly from the lower chord segments, the flanges defining a longitudinally extending continuous web receiving aperture traversing the length of the chord, the web receiving apertures of the upper and lower chords being positioned in opposed relationship;

a plurality of web members, each of the web members comprising an upper web segment, the width of the upper web segment being equal to the width of the web receiving aperture, opposed parallel side walls extending perpendicularly from the upper web segment, and inwardly extending lower web segments, the inwardly extending lower web segments defining a longitudinally extending slot, each of the web members having first and second ends received in the web receiving aperture; and a saddle, the saddle having an upper saddle member, opposed parallel side walls and outwardly extending bearing plates, the outwardly extending bearing plates being parallel to the upper saddle member, the upper chord of the joist receiving the saddle in the member receiving aperture at opposed ends of the joist to support the joist.

2. The joist system of claim 1 wherein the inside surface of the upper chord segment of the chord is in abutting relationship with the exterior surface of the upper member of the saddle when the chord is seated on the saddle.

3. The joist system of claim 1 wherein the intersection of the web members and the chords defines an incident angle of from about 15° to about 60°.

4. The joist system of claim 1 wherein the width of the top member of the saddle is equal to the width of the web receiving aperture.

5. The joist system of claim 1 wherein the ends of adjacent web members are in abutting relationship.

6. The joist system of claim 1 wherein the web members are secured to the upper and lower chords with mechanical means selected from the group consisting of screws, bolts, welds and rivets and combinations thereof.

7. The joist system of claim 1 wherein the side walls of the web members abut the flanges of the upper and lower chords.

8. The joist system of claim 1 wherein the opposed parallel side walls of the chord are substantially perpendicular to the upper chord segment of the chord.

9. The joist system of claim 1 wherein the flanges of the chord are substantially parallel to the opposed side walls of the chord.

10. The joist system of claim 1 wherein the web members are substantially rectangular in cross-section.

11. A joist comprising:

upper and lower longitudinally extending chords, the upper and lower chords being substantially parallel, and a plurality of web members interposed between the parallel chords;

each of the chords, including an upper chord segment, side walls, inwardly extending lower chord segments, the lower chord segments being parallel to the upper chord segment, and a pair of flanges extending downwardly from the lower chord segments, the flanges being parallel to the side walls, the flanges defining a longitudinally extending continuous web receiving aperture traversing the length of the chord, the web receiving apertures of the upper and lower chords being positioned in an opposed relationship;

a plurality of web members, each of the web members comprising an upper web segment, opposed parallel side walls extending perpendicularly from the upper web segment, and inwardly extending lower web segments, each of the web members having first and second ends received in the web receiving aperture, the intersection of the web members and the chords defining an incident angle of from about 15° to about 60°.

12. The joist of claim 11 wherein the side walls of the chord are opposed and parallel to each other and substantially perpendicular to the upper chord segment of the chord.

13. The joist of claim 11 wherein the width of the upper web segment of the web member is equal to the width of the web receiving aperture.

14. The joist of claim 11 wherein the upper chord is adapted to be seated in an abutting relationship on a saddle, the saddle having an upper saddle member, opposed parallel side walls and outwardly extending bearing plates, the outwardly extending bearing plates being parallel to the upper saddle member, the upper chord of the joist receiving the saddle in the member receiving aperture at opposed ends of the joist to support the joist.

15. The joist of claim 11 wherein the web members are substantially rectangular in cross-section.

16. The joist of claim 11 wherein the inwardly extending members of the web members define a longitudinally extending slot.

17. A building comprising:

a joist system including upper and lower longitudinally extending chords, the upper and lower chords being substantially parallel, and a plurality of web members interposed between the parallel chords;

each of the chords including an upper chord segment, opposed parallel side walls, inwardly extending lower chord segment, the lower chord segments being parallel to the upper chord segment, and a pair of flanges extending downwardly from the lower chord segment, the flanges defining a longitudinally extending continuous web receiving aperture traversing the length of the chord, the upper chord segment, lower chord segment, parallel side walls and flanges being integrally formed, the web receiving apertures of the upper and lower chords being positioned in opposed relationship;

a plurality of web members, each of the web members comprising an upper web segment, the width of the upper web segment being equal to the width of the web receiving aperture, opposed parallel side walls extending perpendicularly from the upper web segment, and inwardly extending lower web segments, the inwardly extending lower web segments defining a longitudinally extending slot, each of the web members having first and second ends received in the web receiving aperture; and a saddle, the saddle having an upper saddle member, opposed parallel side walls and outwardly extending bearing plates, the outwardly extending bearing plates being parallel to the upper saddle member, the upper chord of the joist receiving the saddle in the member receiving aperture at opposed ends of the joist to support the joist.

18. The building of claim 17 wherein the inside surface of the upper chord segment of the chord is in abutting relationship with the exterior surface of the upper saddle member of the saddle when the chord is seated on the saddle and wherein the intersection of the web members and the chords defines an incident angle of from about 15° to about 60°.

19. The building of claim 17 wherein the width of the top member of the saddle is equal to the width of the web receiving aperture and wherein the ends of adjacent web members are in an abutting relationship.

20. The building of claim 17 wherein the web members are secured to the upper and lower chords by welding and wherein the side walls of the web members abut the flanges of the upper and lower chords.

* * * * *